United States Patent [19]

Urban et al.

[11] 4,107,695

[45] Aug. 15, 1978

[54] ANTENNA RAISING AND LOWERING DEVICE

[76] Inventors: Donald E. Urban; Alan G. Urban, both of 7950 SW. 184th St., Miami, Fla. 33157

[21] Appl. No.: 713,609

[22] Filed: Aug. 11, 1976

[51] Int. Cl.[2] ..... H01Q 15/20

[52] U.S. Cl. ..... 343/882; 343/713

[58] Field of Search ..... 343/713, 714, 715, 900, 343/901, 882; 248/535, 533; 52/110

[56] References Cited

U.S. PATENT DOCUMENTS

| | | | |
|---|---|---|---|
| 2,313,652 | 3/1943 | Lyman | 52/110 |
| 2,329,200 | 9/1943 | Hefele | 343/882 |
| 2,334,503 | 11/1943 | Paton | 343/882 |
| 3,729,741 | 4/1973 | Otto | 343/713 |

*Primary Examiner*—Alfred E. Smith
*Assistant Examiner*—David K. Moore
*Attorney, Agent, or Firm*—Clarence A. O'Brien; Harvey B. Jacobson

[57] ABSTRACT

An antenna raising and lowering device having an antenna mount rotatable laterally of a motor vehicle on which the device is mounted. The torque exerted on the antenna mount by a handle disposed over the driver's side door window of the vehicle is adjustable by varying the deflection of a torsion spring connected to a shaft which rotatably supports the antenna mount. An operator of the motor vehicle can quickly and easily raise and lower an antenna attached to the antenna mount by manipulating the handle from the driver's adjacent window without the necessity of the operator being distracted from operation of the motor vehicle.

3 Claims, 7 Drawing Figures

Fig. 1
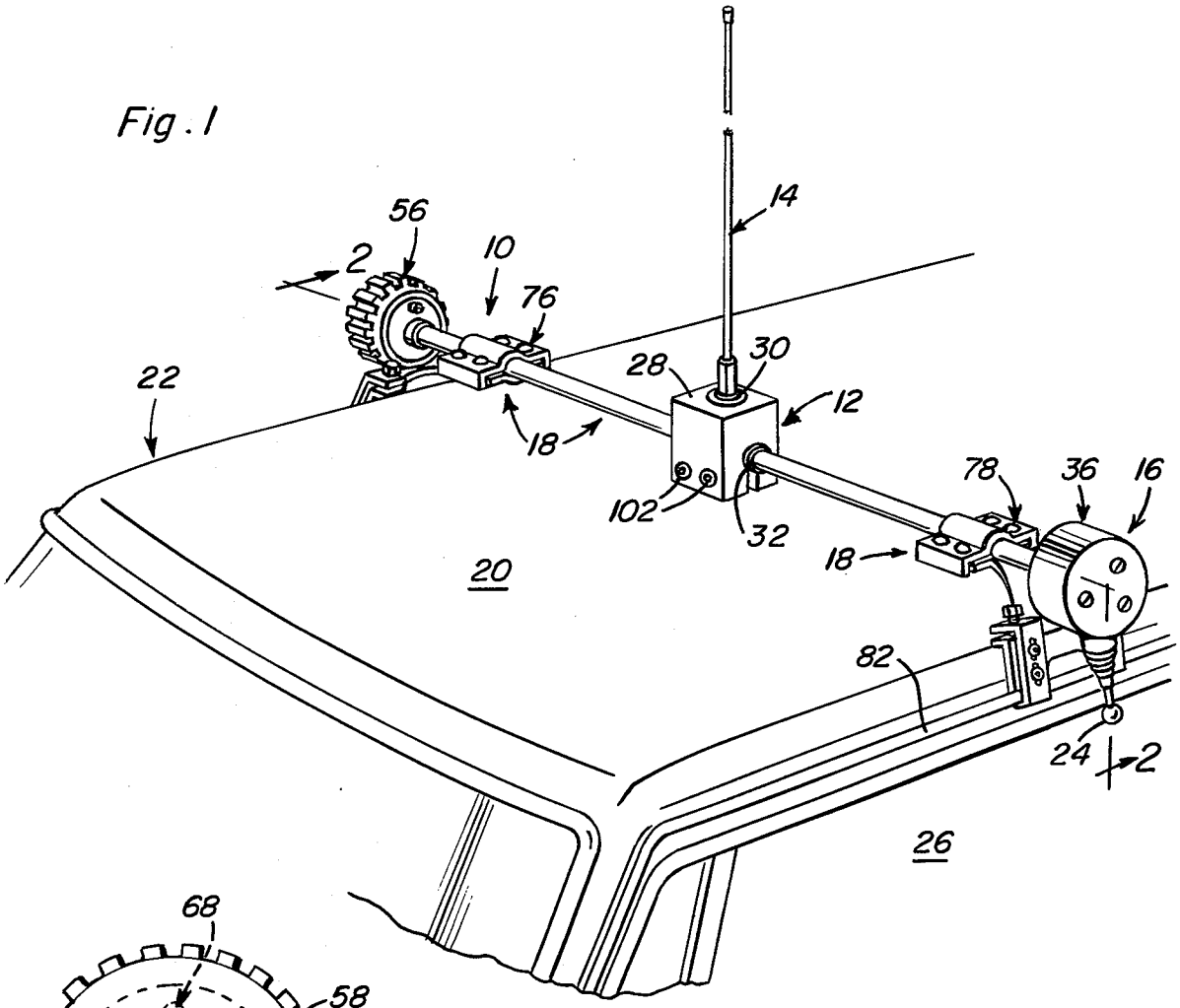
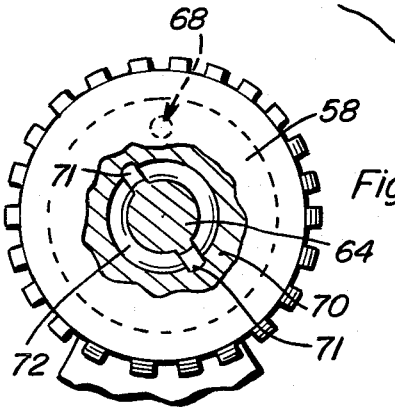
Fig. 6
Fig. 4
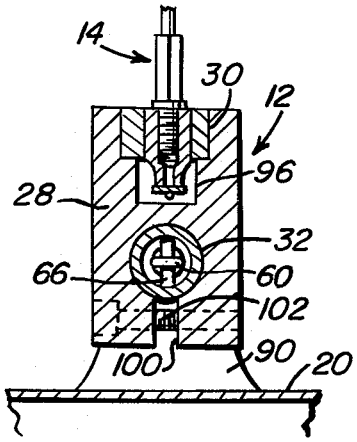
Fig. 5
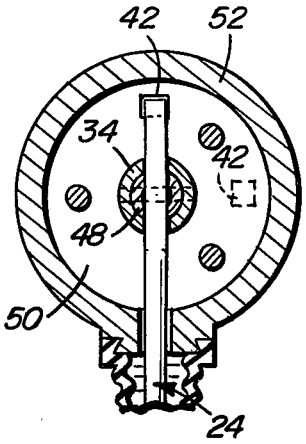
Fig. 7
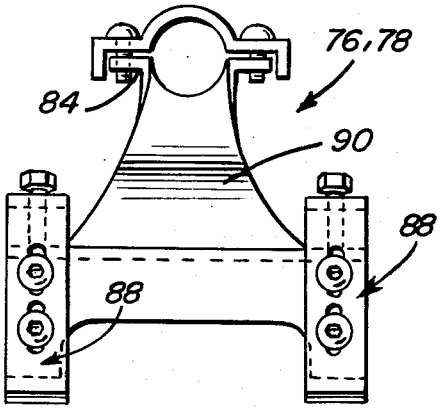

ANTENNA RAISING AND LOWERING DEVICE

BACKGROUND OF THE INVENTION

1. Field of the Invention

This invention relates generally to motor vehicle antenna mounts, and particularly to a device which permits an antenna to be mounted centrally over the roof of a motor vehicle in such a manner that the antenna can be lowered when necessary to prevent the antenna from striking overhead objects such as bridges, trees, garage openings, and the like.

2. Description of the Prior Art

The current boom in the so-called "Citizens Band" (CB) transceivers for use with motor vehicles has created a problem regarding the mounting of the antenna necessary to achieve maximum range of the radio gear. If the maximum permissible height of an antenna is exploited, the height of the antenna above the roof of the motor vehicle is such as to be in the path of garage doors, low lying branches, bridges, and other similar overhead obstructions. Further, it is generally desirable to mount the antenna as close as possible to the center of the vehicle in order to assure optimum reception. The latter criteria makes the antenna height even more critical, since if the ideal location for mounting an antenna is on the roof of a vehicle, as high as possible, the possibility of an antenna of a given length being in the path of overhead obstructions is greatly increased.

U.S. Pat. Nos. 3,408,652, issued Oct. 29, 1968 to J. H. Allisbaugh; 3,230,533, issued Jan. 18, 1966 to R. J. Brill; 2,313,652, issued Mar. 9, 1943 to H. J. Lyman; 2,479,379, issued Aug. 16, 1949 to H. E. F. C. Lingenbrink; 2,214,685, issued Sept. 10, 1940 to L. Stone, Jr.; and 3,928,952, issued Dec. 30, 1975 to T. P. Whyte, all disclose motor vehicle antennas constructed for being moved between a stored position and an operative position. Of these prior art devices, only U.S. Pat. No. 2,214,685 permits the antenna to be mounted centrally of the roof of a vehicle, but such mounting is achieved only by modification of the vehicle's roof by the making of holes in the roof in order to secure bolts, and the like, which anchor the antenna mount. Such modification of the vehicle is, of course, very undesirable.

U.S. Pat. No. 3,729,741, issued Apr. 24, 1973 to O. O. Otto, discloses an automobile antenna support in the form of an arcuate strip of material clamped to the gutters bordering the roof of a motor vehicle so as to be clamped across the roof of the motor vehicle and permit an antenna mounted on the arcuate strip of material to be located substantially centrally of the vehicle's roof. No provision is made, however, for raising and lowering the antenna mounted on the arcuate strip of material.

SUMMARY OF THE INVENTION

It is an object of the present invention to provide an antenna mounting bracket which allows a motor vehicle operator to attach a business or amateur radio antenna to a motor vehicle without structural changes to the vehicle.

It is another object of the present invention to provide an antenna mounting device designed to create better radio reception by allowing the mounting of the antenna close to the center of a vehicle on which an antenna is to be mounted, and to extend as high as legally possible, while still allowing the vehicle operator to lower the antenna to allow travel under obstacles with low clearance, such as garage doors, low lying branches, bridges with low clearance, and the like.

It is still another object of the present invention to permit an operator of a motor vehicle to raise and lower an antenna mounted substantially at the center of the vehicle without the operator being distracted from his driving or having even to leave the vehicle.

These and other objects are achieved according to the present invention by providing an antenna raising and lowering device having: an antenna mount disposed for receiving an antenna suitable for the particular application of the antenna mounting device; an antenna rotating arrangement for turning the antenna mount between an upright raised position and a lowered position adjacent the roof of the motor vehicle; and a clamp assembly securing the antenna mount and the antenna rotating arrangement on the roof of a motor vehicle such that the antenna mount is disposed substantially at the center of the motor vehicle.

According to a preferred embodiment of the present invention, the antenna rotating arrangement includes an actuating handle arranged adjacent a driver's side door window of the associated motor vehicle. This handle is connected to the antenna mount for selectively rotating the antenna mount between an antenna raised position and an antenna lowered position, with the latter disposing the antenna substantially parallel to the plane of the roof of the vehicle.

The antenna mount advantageously is constructed as a block provided with a recess arranged for receiving an antenna, and with a through hole in which is fittingly received a rotatably mounted hollow shaft. The actuating handle is connected to the shaft for causing rotational, or pivotal, movement of the shaft relative to the associated motor vehicle in order to move the antenna mount block, and accordingly the antenna, between the aforementioned raised position and the lowered position.

A lock arrangement is associated with the actuating handle for retaining the handle and its associated shaft in either the raised position and the lowered position. The lock arrangement includes a locking ring mounted on the clamp assembly and provided with a pair of notches arranged for selectively retainingly receiving a lug provided on the handle. The latter is pivotally mounted on its associated shaft for pivotal movement about an axis perpendicular to an axis of rotation of the shaft so as to permit the lug to be selectively inserted into and removed from the notches provided in the locking ring.

The antenna rotating arrangement further includes a torque adjusting arrangement connected to the shaft mounting the antenna mount block for providing sufficient torque at the actuating handle of the device to overcome variable weights and lengths of antenna mounted in the antenna mount. The torque adjusting arrangement includes a knob rotatably mounted on the clamp assembly and connected to a torsion spring also connected to the shaft. By adjusting the amount of torque on the torsion spring, the amount of force required to manipulate handle 12 in order to move the antenna mount block, and the antenna, between the raised position and the lowered position, and vice versa, can be maintained substantially constant despite the exact kind of antenna being mounted. A lock pin, and the like, is selectively engaged with the knob and a fixed retaining ring for retaining the knob, and hence the associated end of the torsion spring, against rotation relative to the clamp assembly.

The clamp assembly advantageously includes two tubes disposed extending between the handle and the knob of the antenna rotating arrangement, and fitting over the shaft so as to abut against the block of the antenna mount. A pair of gutter brackets are slidably mounted on the tubes for lateral adjustment in order to mate with the conventional gutters provided on the roof of motor vehicles and clamp the device onto the roof of a motor vehicle on which an antenna is to be mounted.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, perspective view showing an antenna raising and lowering device according to the present invention mounted on the roof of a motor vehicle.

FIG. 4 is an enlarged, fragmentary, sectional view taken generally along the line 4—4 of FIG. 2.

FIG. 5 is a fragmentary, sectional view taken generally along the line 5—5 of FIG. 2.

FIG. 6 is a fragmentary, end view looking from the left in FIG. 2, with the central portion of the view partly cutaway and in section.

FIG. 7 is a front elevational view showing the gutter-enlarging clamp brackets which permit the antenna raising and lowering device according to the present invention to be attached to the roof of a motor vehicle.

DESCRIPTION OF THE PREFERRED EMBODIMENTS

Figure 2:
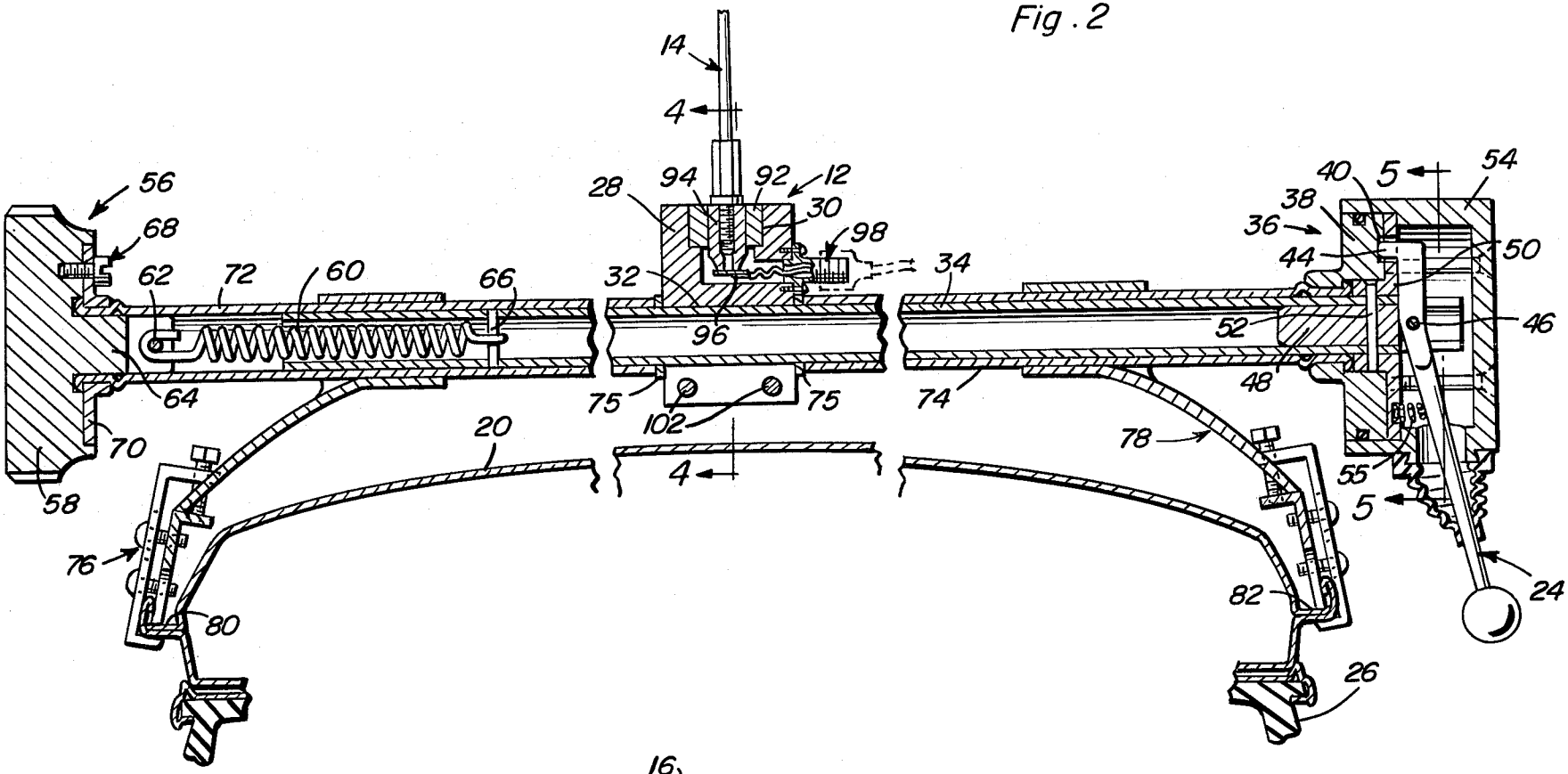
FIG. 2 is an enlarged, fragmentary, sectional view taken generally along the line 2—2 of FIG. 1.
Figure 3:
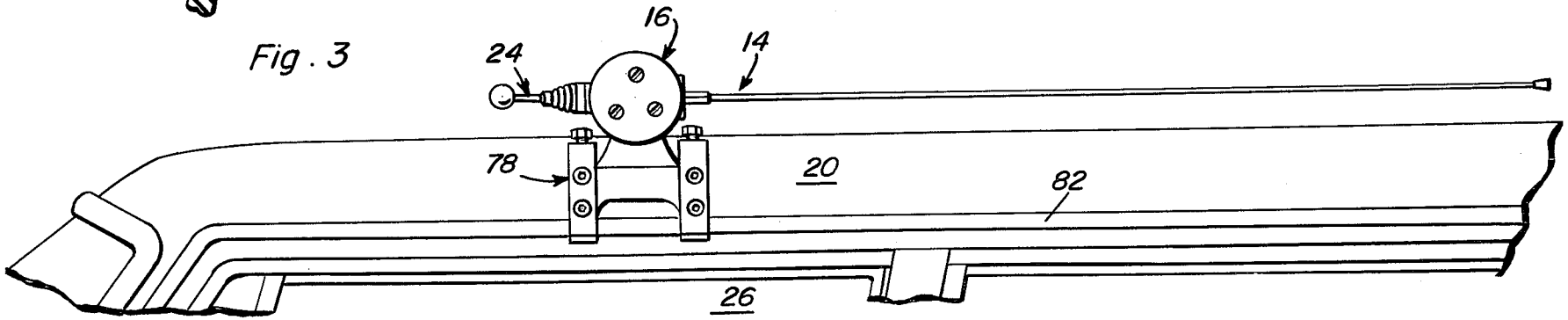
FIG. 3 is a fragmentary, side elevational view showing the structure set forth in FIG. 1 with the antenna raising and lowering device and associated antenna being disposed in the lowered position of the antenna.

Referring now more particularly to FIGS. 1 through 3 of the drawings, an antenna raising and lowering device 10 according to the invention includes an antenna mount 12 which receives a conventional antenna 14. Device 10 also includes an antenna rotating arrangement 16 for turning the antenna mount 12 between an upright position as shown in FIG. 1 and a lowered position as shown in FIG. 3. A clamp assembly 18 secures the antenna mount 12 and the antenna rotating arrangement 16 on the roof 20 of a motor vehicle 22. As can be seen from FIG. 3, antenna 14 is substantially parallel to roof 20 when device 10 is in its lowered position.

The antenna rotating arrangement 16 includes an actuating handle 24 arranged adjacent a driver's side door window 26 of motor vehicle 22 and connected to the antenna mount 12. The latter is disposed centrally of the width of the motor vehicle 22 and substantially mid-way along the length of the vehicle in order to obtain optimum reception of a radio (not shown), and the like, connected to antenna 14 in a conventional manner.

Antenna mount 12 includes a block 28 provided with a recess 30 arranged for receiving antenna 14. Block 28 is also provided with a through hole 32 in which is fittingly received a rotatably mounted hollow shaft 34. This shaft 34 rotates block 28, with the actuating handle 24 being affixed to shaft 34 for rotating, or pivoting, the shaft 34.

The antenna rotating arrangement 16 further includes a lock arrangement 36 associated with the actuating handle 24 for retaining the handle 24, together with the shaft 34, in the raised and lowered positions of device 10. Lock arrangement 36 includes a locking ring 38 mounted on the clamp assembly 18 and provided with a pair of notches 40 and 42 (FIG. 5) arranged for selectively, retainingly receiving a lug 44 provided on handle 24. The latter is pivotally mounted on shaft 34 for movement about an axis perpendicular to an axis of rotation of shaft 34 which is defined by the longitudinal extent of the shaft 34. The pivotal mounting of handle 24 on the shaft 34 may be accomplished in a conventional manner, such as by the illustrated pin 46, while a plug 48 is inserted into the right-hand end of shaft 34 and is connected to an inner hub 50 as by a roll pin 54 so that shaft 34 will be rigidly attached to the hub 50. An outer hub 54 is mounted on the hub 50 as by the illustrated bolts so as to form a protective housing for the lock arrangement 36. The illustrated resilient shroud shown surrounding the shaft portion of the handle 24 completes the protective housing for lock arrangement 36, which protective housing prevents dirt, moisture, and the like, from entering into lock arrangement 36 and affecting the functioning thereof.

A suitable compression spring 55, and the like, is advantageously inserted between the shaft portion of handle 24 and a recess suitably provided in the hub 50 for biasing the handle 24 toward a position in which the lug 44 is in engagement with one of the notches 40 and 42.

The antenna rotating arrangement 16 further includes a torque adjusting arrangement 56 connected to shaft 34 for providing sufficient torque to the handle 24 in order to overcome variable weights and lengths of antenna 14 mounted on the antenna mount 12. By means of arrangement 56, the amount of force required to turn handle 24, and therefore the antenna 14, to and from the raised and lowered positions, can be made substantially constant. Torque adjusting arrangement 56 includes a knob 58 rotatably mounted on the clamp assembly 18, and a torsion spring 60 connected to knob 58 as by a suitable pin 62 disposed in the bifurcated portion of shank 64 of knob 58, and to shaft 34 as by a suitable pin 66 for rotation with each of the knob 58 and shaft 34.

A lock pin 68 selectively engages knob 58 and a retaining ring 70 affixed to the left end of the clamp assembly 18 as by suitable keys 71 (FIG. 6). This lock pin 68 causes the knob 58 to be retained against rotation after the torsion spring 60 has been set at a desired amount of torque in order to permit handle 24 to be manipulated with only a predetermined amount of force.

Clamp assembly 18 includes two tubes 72 and 74 disposed extending between the knob 58 and the handle 24, and movably disposed over the shaft 34 so as to abut the block 28. As illustrated, washers 75 are disposed between the inward ends of the tubes 72 and 74 and the associated adjacent surfaces of the block 28 in order to reduce friction between the tubes 72, 74 and the block 28 during rotation of the block 28 relative to the tubes 72 and 74. A pair of gutter brackets 76 and 78 are slidably disposed on the tubes 72 and 74, respectively, for lateral adjustment relative to the tubes 72, 74 in order to matingly engage with respective gutters 80 and 82 conventionally provided along the side portions of a roof 20 of a motor vehicle 22. In this manner, clamp assembly 18 can be adjusted to fit almost any width of roof which is encountered among standard production motor vehicles. Referring to FIG. 7, it can be seen that each of the brackets 76, 78 includes a split ring clamp 84 and a pair of vise-like clamps 86 and 88 disposed for engaging the gutters 80 and 82 and connected to the clamp 84 by a web 90. The clamp 84 permits attachment of a bracket 76, 78 to a respective tube 72, 74 in such a manner that the bracket 76, 78 can be moved along the longitudinal length of the associated tube 72, 74 and then clamped down onto the respective tube 72, 74 when the desired location is found in order to rigidify the clamp assembly 18. In a similar manner, the movable portions of the clamps 86 and 88 can be brought down tightly against the inner surfaces of the gutters 80, 82 in such a manner that the lips provided on the clamps 86, 88 cooperate with the movable portion of the clamps 86, 88 in order to securely grip the gutter 80, 82, with the movable portion being held rigidly in the desired position as by the illustrated screws.

Referring again to FIGS. 2 and 4 of the drawings, it can be seen that a bushing 92 is inserted into the recess 30 provided in block 28 in order to receive a threaded insert 94 which threadingly engages with the threads conventionally provided at the lower portion of antenna 14 in order to retain antenna 14 securely within block 28. Insert 94 also functions as a conductor which transmits a signal between antenna 14, through a cavity 96 provided in block 28, and to a suitable antenna connector 98 which will connect the antenna 14 to a conventional radio, and the like, not shown. A channel 100 provided in the bottom of block 28 and cooperating threaded bores which receive a bolt 102 permit the block 28 to be securely affixed to shaft 34 at a desired point along the longitudinal extent of shaft 34. Further, the use of the channel 100 and the associated bolts 102 will permit the antenna mount 12 to be properly oriented angularly on shaft 34 with respect to the handle 24.

As can be readily understood from the above description and from the drawings, an antenna raising and lowering device according to the present invention is adaptable to all sorts of conventional motor vehicles having hard tops without modification to any part of the vehicle. The line running from the connector 98 can pass into the vehicle in a conventional manner which may or may not require the making of a hole in the vehicle in dependence on the particular motor vehicle involved. Further, the portability of the device 10 allows easy removal from the roof of a motor vehicle, thus making it possible to easily remove the entire antenna assembly and prevent vandalism or theft of the equipment.

If desired, a motor (not shown) can be substituted for handle 24 in order to permit remote operation of the device.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An antenna raising and lowering device, comprising, in combination:

(a) antenna mount means for receiving an antenna;

(b) antenna rotating means for turning the antenna mount means between an upright raised position and a lowered position adjacent the roof of a motor vehicle on which the device is to be mounted; and (c) clamp means for securing the antenna mount means and the antenna rotating means on the roof of the motor vehicle, the antenna rotating means including an actuating handle arrangeable adjacent a driver's side door window of the motor vehicle and connected to the antenna mount means, lock means associated with the handle for retaining the handle in the raised position and lowered position of the antenna rotating means, the antenna mount means being disposed centrally of the width of the motor vehicle and including a block provided with a recess arranged for receiving an antenna and with a through hole, and the antenna rotating means further including a longitudinally extending, rotatably mounted, hollow shaft having longitudinally spaced ends and journaled on the clamp means and fittingly received in the hole provided in the block of the antenna mount means for rotating the block, with the shaft being arrangeable traverse of the width of the vehicle and the block being disposed centrally of the shaft and the actuating handle being affixed to one of the ends of the shaft for rotating the shaft, the antenna rotating means further including torque adjusting means connected to the other of the ends of the shaft and spaced from the lock for providing sufficient torque to overcome variable weights and length of antenna mounted on the antenna mount means, the torque adjusting means including a knob rotatably mounted on the clamp means and a torsion spring disposed within the hollow shaft and connected to the knob and to the shaft for rotation with each, and a lock pin keyed to the clamp means and selectively engaging the knob for retaining the knob against rotation.

2. A structure as defined in claim 1, wherein the lock means includes a locking ring mounted on the clamp means and provided with a pair of notches arranged for selectively retaining and receiving a lug provided on the handle, with the latter being pivotally mounted on the shaft for movement about an axis perpendicular to an axis of rotation of the shaft.

3. An antenna raising and lowering device, comprising, in combination:

(a) antenna mount means for receiving an antenna;

(b) antenna rotating means for turning the antenna mount means between an upright raised position and a lowered position adjacent the roof of a motor vehicle on which the device is to be mounted; and (c) clamp means for securing the antenna mount means and the antenna rotating means on the roof of the motor vehicle, the antenna mount means includes a block provided with a recess arranged for receiving an antenna and with a through hole, and the antenna rotating means including a longitudinally extending rotatably mounted, hollow shaft having longitudinally spaced ends and journaled on the clamp means and fittingly received in the hole provided in the block for rotating the block, with the shaft being arrangeable transverse of the width of the vehicle and the block being disposed centrally of the shaft and the antenna rotating means further including an actuating handle affixed to one of the ends of the shaft for rotating the shaft, the antenna rotating means further including lock means associated with the handle for retaining the handle and the shaft in the raised and lowered positions of the antenna rotating means, the lock means including a locking ring mounted on the clamp means and provided with a pair of notches arranged for selectively retaining and receiving a lug provided on the handle, with the latter being pivotally mounted on the shaft for movement about an axis perpendicular to an axis of rotation of the shaft, the antenna rotating means still further including torque adjusting means connected to the other of the ends of the shaft, spaced from the handle, for providing sufficient torque to overcome variable weights and length of antenna mounted on the antenna mount means, the torque adjusting means including a knob rotatably mounted on the clamp means and a coiled torsion spring disposed within the hollow shaft and connected to the knob and to the shaft for rotation with each, a pin attached to and extending through the shaft, with the spring being connected to the pin, and a lock pin mounted on the clamp means and selectively engaging the knob for retaining some against rotation once a desired amount of torque has been placed on the torsion spring to permit the handle to be manipulated with a predetermined amount of force.

* * * * *